US005494113A

United States Patent [19]

Polan

[11] Patent Number: 5,494,113

[45] Date of Patent: Feb. 27, 1996

[54] SPRINKLERS WITH SHAPE-MEMORY ALLOY ACTUATORS

[75] Inventor: George S. Polan, Perkiomenville, Pa.

[73] Assignee: Central Sprinkler Corporation, Lansdale, Pa.

[21] Appl. No.: 189,820

[22] Filed: Feb. 1, 1994

[51] Int. Cl.[6] ..... A62C 37/08

[52] U.S. Cl. ..... 169/37; 169/38

[58] Field of Search ..... 169/37, 38, 39, 169/90, 40, 41, 42

[56] References Cited

U.S. PATENT DOCUMENTS

| | | | |
|---|---|---|---|
| 2,396,906 | 3/1946 | Windson | 46/90 |
| 3,561,537 | 2/1971 | Dix et al. | 169/38 |
| 3,740,839 | 6/1973 | Otte et al. | 29/628 |
| 3,783,429 | 1/1974 | Otte | 337/393 |
| 4,414,716 | 11/1983 | Stastney | 24/3 |
| 4,491,182 | 1/1985 | Pieczykolan | 169/38 |
| 4,596,483 | 6/1986 | Gabriël | 403/28 |
| 4,893,679 | 1/1990 | Martin et al. | 169/39 |
| 4,976,320 | 12/1990 | Polan | 169/39 |
| 5,083,616 | 1/1992 | Polan | 169/40 |
| 5,097,906 | 3/1992 | Polan | 169/39 |

OTHER PUBLICATIONS

The Viking Corporation, Micromatic® Model A Concealed Sprinkler/Technical Data, Form No. 011089 Jul. 31, 1989.

Kauffman and Mayo, "The Metal With a Memory", *American Heritage Invention & Technology,* vol. 9, No. 2, pp. 18–23, Fall 1993.

Schetky, "Shape–Memory Alloys" *Scientific American,* vol. 241, No. 5, pp. 74–82, Nov. 1979.

Hodgson et al., "Shape Memory Alloys," *Metals Handbook,* vol. 2, 10th ed., Oct. 1990.

*Primary Examiner*—Stephen Avila

*Attorney, Agent, or Firm*—Panitch Schwarze Jacobs & Nadel

[57] ABSTRACT

An automatic sprinkler includes a sprinkler body having a fluid passage outlet. A valve plug is maintained in sealing engagement with the fluid passage outlet by one or more control levers which react against the sprinkler body. Each control lever is held in position by a temperature-responsive actuator made from a generally C-shaped band of shape-memory alloy. The control band may be rigidly secured to one of the control levers. Upon an occurrence of a high-temperature condition, opposed ends of the control band spread apart in a common plane, releasing all control levers thereby permitting all control levers to pivot relative to the sprinkler body and release the valve plug from sealing engagement with the fluid passage outlet.

31 Claims, 4 Drawing Sheets

SPRINKLERS WITH SHAPE-MEMORY ALLOY ACTUATORS

FIELD OF THE INVENTION

The present invention relates to temperature-responsive automatic sprinklers. More specifically, the present invention relates to automatic sprinklers for fire protection systems which employ actuators made from shape-memory alloys.

BACKGROUND OF THE INVENTION

In fire protection systems, automatic sprinklers are typically employed to discharge water onto a fire when a predetermined high-temperature condition is reached in the ambient environment. A conventional automatic sprinkler includes a sprinkler body having a fluid passage formed therein and a valve plug which is adapted to seal the fluid passage outlet. A temperature-responsive element is utilized to normally maintain the valve plug in sealing engagement with the outlet. When the predetermined high-temperature condition is reached, the temperature-responsive element ruptures, disassociates, or otherwise changes in shape to release the valve plug from sealing engagement with the fluid passage outlet and thereby actuate the sprinkler.

Conventionally, the temperature-responsive element may take a number of forms, including that of an alcohol-filled frangible bulb, a releasable soldered plate assembly, a fusible link, or a bimetallic element. In U.S. Pat. No. 3,561,537, for example, the temperature-responsive element takes the form of a bowed bimetallic element 80 (FIG. 5) that tends to straighten as the ambient temperature rises, thereby unlatching the lever 73 from behind the strut 71 and actuating the sprinkler.

It has been proposed, for example in U.S. Pat. No. 4,596,483 (incorporated by reference herein), to utilize a shape-memory alloy (SMA) as the temperature-responsive element in an automatic sprinkler. Specifically, as shown in FIG. 7 of the '483 patent, a linkage element 38 made from a shape-memory alloy includes a pair of coplanar jaws and is employed to normally restrain movement of the lever arm 35 away from the lever arm 36. In this condition, a cover 31 is maintained in sealing engagement with a threaded tube end 30, whereby water is prevented from being discharged from the sprinkler. When the temperature of the ambient environment rises due to a fire, the jaws spread apart from each other in a direction substantially perpendicular to the plane of the jaws (see FIG. 3). The linkage element 38 then pivots relative to both the lever arm 35 and the lever arm 36 (see FIG. 4) so as to release the lever arm 35 from the lever arm 36. The cover 31 is thus permitted to separate from the threaded tube end 30, thereby actuating the sprinkler.

In order to ensure safety in the operation of automatic sprinklers, organizations such as the Underwriter's Laboratories (UL) and the National Fire Prevention Association (NFPA) have promulgated standards and minimum specifications for both commercial and residential automatic sprinklers. For example, in order for a commercial automatic sprinkler to obtain a "Quick Response" rating under UL Standard "UL-199" (the entire text of which is incorporated by reference herein), the sprinkler having a 155° F.–165° F. rated element must actuate within about 14 seconds when mounted in a UL designed fixture and held in a 275° F. air stream moving at a rate of about 8.33 feet per second. Other standards and minimum specifications for commercial and residential standards are set forth in UL Standard "UL-1626", "UL-199" and NFPA Standards "NFPA 13" and "NFPA 13R" (residential), all of which are incorporated by reference.

SUMMARY OF THE INVENTION

Briefly stated, in one respect the invention is directed to a sprinkler comprising a sprinkler body that includes a fluid passage with an inlet and an outlet; a valve plug; and a temperature-responsive retaining mechanism supported by the sprinkler body and releasably retaining the valve plug in sealing engagement with the fluid passage outlet. The retaining mechanism includes a temperature responsive control band, a control lever, and a locating member. The control band has a generally C-shaped cross-section in a reference plane which extends laterally through the control band and defines a pair of spaced-apart arms which extend laterally within the reference plane. When the control band is in a low-temperature condition, the control lever and the locating member are supported by the control band such that a first portion of the control lever reacts, at least indirectly, against the sprinkler body, a second portion of the control lever urges the valve plug into sealing engagement with the fluid passage outlet, a third portion of the control lever reacts against the locating member through the control band, and the locating member reacts, at least indirectly, against the sprinkler body. In this manner, the valve plug is retained in sealing engagement with the fluid passage outlet. However, when the control band undergoes a transition from the low-temperature condition to a high-temperature condition, a distance between the spaced-apart arms of the control band as measured in the reference plane increases sufficiently for the control band to release the supported control lever and the locating member with a relative movement between the third portion of the control lever and the locating member and a movement of the second portion of the control lever away from the valve plug, thereby permitting release of the valve plug from sealing engagement with the fluid passage outlet.

In another respect, the present invention is directed to a sprinkler having a sprinkler body that includes a fluid passage with an inlet and an outlet; a valve plug; and a temperature-responsive retaining mechanism supported by the sprinkler body releasably retaining the valve plug in sealing engagement with the fluid passage outlet. The retaining mechanism includes a temperature-responsive control band and a control lever. The control band has a generally C-shaped cross-section in a reference plane which extends laterally through the control band and defines a pair of spaced-apart arms which extend laterally within the reference plane. When the control band is in a low-temperature condition, the control lever is supported by the control band relative to the sprinkler body such that a first portion of the control lever reacts, at least indirectly, against the sprinkler body, a second portion of the control lever urges the valve plug into sealing engagement with the fluid passage outlet and a third portion of the control lever reacts against the sprinkler body through at least the control band to retain the valve plug in sealing engagement with the fluid passage outlet. However, when the control band undergoes a transition from the low-temperature condition to a high-temperature condition, a distance between the spaced-apart arms of the control band increases as measured in the reference plane sufficiently to permit a relative movement between the third portion of the control lever and the sprinkler body and a movement of the second portion of the control lever away from the valve plug, thereby permitting release of the valve plug from sealing engagement with the fluid passage outlet.

In yet another aspect, the invention is directed to a sprinkler having a sprinkler body that includes a fluid passage with an inlet and an outlet; a valve plug; and a temperature-responsive retaining mechanism is supported by the sprinkler body releasably retaining the valve plug in sealing engagement with the fluid passage outlet. The retaining mechanism includes a temperature-responsive control band, a control lever, and a locating member. The control band is rigidly secured to a first one of the control lever and the locating member. When the control band is in a low-temperature condition, the control lever and the locating member are supported relative to the sprinkler body by the control band such that a first portion of the control lever reacts, at least indirectly, against the sprinkler body, a second portion of the control lever urges the valve plug into sealing engagement with the fluid passage outlet, a third portion of the control lever reacts against the locating member through the control band, and the locating member reacts, at least indirectly, against the sprinkler body to retain the valve plug in sealing engagement with the fluid passage outlet. However, when the control band undergoes a transition from the low-temperature condition to a high-temperature condition, the control band changes in shape sufficiently to release a second one of the control lever and the locating member with a relative movement between the third portion of the control lever and the locating member and a movement of the second portion of the control lever away from the valve plug, thereby permitting release of the valve plug from sealing engagement with the fluid passage outlet.

In still another aspect, the present invention is directed a sprinkler which includes a sprinkler body having a fluid passage with an inlet and an outlet; a valve plug; and a temperature-responsive retaining mechanism, which includes a temperature-responsive shape-memory alloy actuator and which releases the valve plug from sealing engagement with the fluid passage outlet within 14 seconds when the shape-memory alloy actuator is exposed to a stream of hot air having a temperature of about 275° F. and moving at a rate of about 8.33 feet per second.

The present invention is also directed to a method of operating a sprinkler having a fluid passage inlet adapted to be connected to a source of fluid under pressure and a fluid passage outlet with a valve plug. The method includes the steps of providing a temperature-responsive retaining mechanism releasably retaining the valve plug in sealing engagement with the fluid passage outlet, the temperature-responsive retaining mechanism including a shape-memory alloy actuator, and automatically releasing the valve plug from sealing engagement with the fluid passage outlet within 14 seconds of the shape-memory alloy actuator being exposed to a stream of hot air having a temperature of about 275° F. and moving at a rate of about 8.33 feet per second.

BRIEF DESCRIPTION OF THE DRAWINGS

The foregoing summary, as well as the following detailed description of the presently preferred embodiments of the invention, will better be understood when read in conjunction with the appended drawings. For the purposes of illustrating the invention there is shown in the drawings embodiments of the invention which are presently preferred. It should be understood, however, that the present invention is not limited to the particular arrangements and instrumentalities shown. In the drawings.

DETAILED DESCRIPTION OF THE PREFERRED EMBODIMENTS

Figure 2:
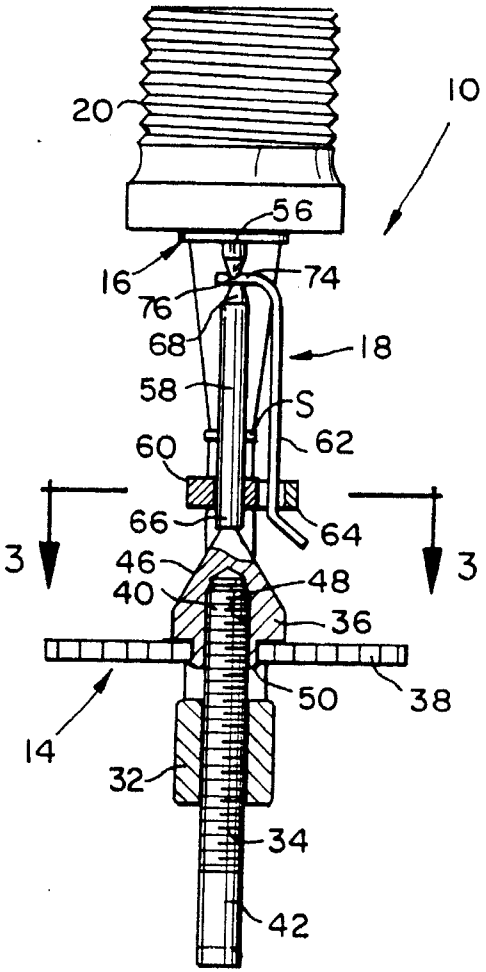
FIG. 2 is a side view in partial cross-section of the sprinkler shown in FIG. 1.

Referring now to the drawings in detail, wherein like numerals indicate like elements throughout, there is shown in FIGS. 1 to 5 a first presently preferred embodiment of an automatic sprinkler, indicated generally at 10. The sprinkler 10, which is of the frame-type, is shown in its non-actuated state. The sprinkler 10 includes a sprinkler body or frame indicated generally at 12, a deflector plate assembly indicated generally at 14, a valve plug 16, and a temperature-responsive retaining mechanism indicated generally at 18.

Figure 1:
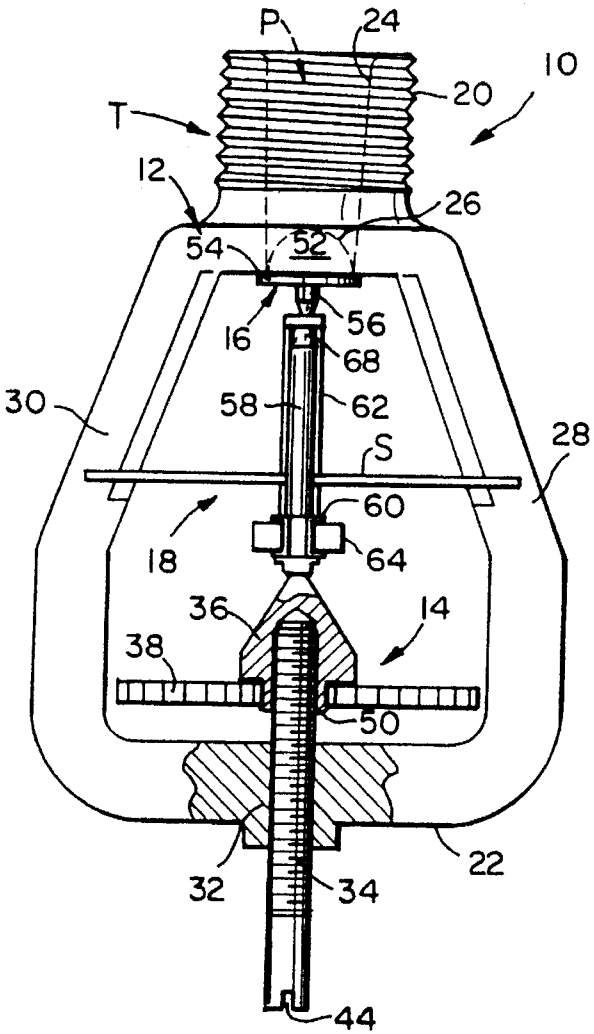
FIG. 1 is a frontal view in partial cross-section of a sprinkler according to a first embodiment of the invention.

As shown in FIGS. 1 and 2, the sprinkler body 12 (which is preferably made from brass, stainless steel, or other durable, non-corroding conventional sprinkler frame material) comprises a tubular conduit portion indicated generally at 20 formed integrally with a frame arm portion indicated generally at 22. The tubular conduit portion 20 comprises a threaded end T which is adapted to be connected to a conduit network of a fire protection system (not shown) and a fluid passage P (indicated in phantom) having an inlet 24 and an outlet 26. The frame portion 22 includes a pair of opposed arms 28, 30 which extend downwardly from the threaded conduit portion 20 and which join together at a knuckle 32 provided in a lower or remote region of the frame arm portion 22.

The deflector plate assembly 14 is conventional but includes at least a deflector plate 38. In the embodiment shown, which is, more particularly, of the Early Suppression Fast Response type, a threaded member 34 and a deflecting cone 36 are also preferably provided. The threaded member 34, is threadingly received within the knuckle 32 and comprises an upper or inner end 40 and a lower or outer end 42. The upper end 40 preferably extends above the knuckle 32 and supports the deflecting cone 36 and the deflector plate 38; the lower end 42 is preferably provided with a tool engagement section 44 that facilitates the turning of the threaded member 34 relative to the sprinkler body 12 (e.g. for adjusting the height of the deflector plate assembly 14 during assembly of the retaining mechanism 18 into the sprinkler body 12). The deflecting cone 36 comprises an upper conical surface 46, a downwardly opening internal bore 48, and a downwardly extending locating flange 50 surrounding the downwardly opening bore 48. The upper conical surface 46 terminates in an apex. The downwardly opening bore 48 is coaxially located relative to the upper conical surface 46 and securely receives the upper end 40 of the threaded member 34. The deflector plate 38 is preferably located on and supported by the locating flange 50 in a friction locking and/or form locking manner. As shown in FIG. 1, the valve plug 16 includes, in the preferred embodiment, an inner portion 52 integrally formed with a supporting base 54 having a pointed projection 56. The plug 16 is conventional and is preferably made from conventional plug valve material(s).

Figure 3:
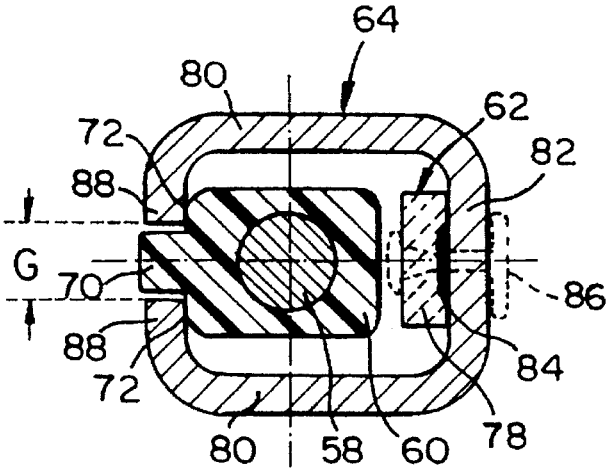
FIG. 3 is a cross-sectional view taken along lines 3—3 in FIG. 2.

In the preferred embodiment, the temperature-responsive retaining mechanism 18 includes a stem or locating member 58, a retainer member 60, control lever 62, and an actuator in the form of a control band 64. The locating member 58 is supported on the apex of the deflecting cone 36 and comprises a lower end 66 and an upper end 68. A concave or internally conical surface (not shown) is preferably provided at a lower end 66 of the locating member 58; this concave or internally conical surface cooperates with the upper conical surface 46 of the deflecting cone 36 to locate and align the locating member 58 relative to the deflecting cone 36. The upper end 68 of the locating member 58 is preferably tapered. The retainer member 60 is preferably made from plastic or ceramic and securely surrounds the locating member 58. As shown in FIG. 3, the retainer member 60 preferably includes an alignment tab 70 and a pair of tapered or rounded surfaces 72 extending away from either side of the base of the tab 70. The control lever 62 is generally Z-shaped in the preferred embodiment and comprises a first portion 74 which engages the upper end 68 of the locating member 58 and reacts against the sprinkler body 12, at least indirectly through the locating member 58 and the deflector plate assembly 14. A second portion 76 of the control lever 62 engages the tapered projection 56 and urges the valve plug 16 into sealing engagement with the fluid passage outlet 26. A third portion 78 of the control lever 62 reacts against the locating member 58 (and thus ultimately against the sprinkler body 12) through the actuator in the form of a control band 64 thereby retaining the plug valve 16 in sealing engagement with the fluid passage outlet 26. Accordingly, when the sprinkler 10 is in the non-actuated state, the control lever 62, which is preferably made from non-corroding metal alloys is held in a residual (e.g. continual) state of stress due to the combined reaction forces of the valve plug 16, the locating member 58, and the control band 64. To aid in stabilizing the retaining mechanism 18 when the sprinkler 10 is in the non-actuated state, the first and second portions 74, 76 of the control band 64 are each provided with a small depression or concavity (unnumbered) at the respective point of engagement with the locating member 58 or the valve plug 16; the tapered tip 68 of the locating member 58 and of the projection 56 thus register with the small depressions or concavities in the first and second portions 74, 76 of the control band 64.

As shown in FIG. 3, the actuator in the form of a control band 64 is generally C-shaped in cross-section when viewed in a reference plane (e.g. indicated at 3—3 in FIG. 2) extending laterally through the control band 64. The control band 64 thus defines a pair of spaced-apart arms 80 (e.g. having substantially uniform cross-sections) which extend laterally within the reference plane from a base portion 82 of the control band 64. In the preferred embodiment, the base portion 82 is preferably rigidly secured to the third portion 78 of the control lever 62 either by a spot weld, indicated generally at 84, or by a rivet, indicated in phantom at 86. (If the control band 64 is riveted to the control lever 62, then a heat insulating layer may be advantageously interposed between the control band 64 and the control lever 62.) The spaced-apart arms 80 are generally straight and at least initially extend in generally axial directions from the base portion 82. As shown in FIG. 3, the spaced-apart arms 80 terminate at in-turned, opposed ends 88. The in-turned, opposed ends 88 are preferably aligned (e.g. parallel) and are finished so as to have burr-free surfaces. The opposed ends 88 may additionally be coated with a low-friction compound such as polytetrafluoroethylene (PTFE).

According to the preferred embodiment, the control band 64 is made from or comprises a temperature-responsive shape-memory alloy (SMA). Preferably, a suitable nickel-titanium alloy (e.g. Nitinol) or another marmem alloy is selected which changes its shape when heated to a high-temperature condition, preferably above a predetermined transitional temperature range, e.g. between about 155° F. and 165° F.

Shape-memory alloys have the characteristic that they can be deformed from an original shape while at relatively low temperatures, and then, if they are heated to some higher temperature, will automatically return to their original shape. These alloys are thus said to "remember" their original shape. More specifically, when a shape-memory alloy element is in a low-temperature condition (i.e. below its predetermined transition temperature range), a crystalline configuration or material phase known as martensite exists in the alloy. If the alloy is subsequently heated to a high-temperature condition (i.e. preferably at least sufficiently into or above the predetermined transition temperature range), a phase transition from the martensite phase back to an original parent or "beta" phase occurs. In nickel-titanium alloys, the beta phase is austenite. Upon the occurrence of this phase transition, any deformation of the element which occurred while the alloy was in the martensite phase is "forgotten" and the shape of the element reverts to a "pre-martensite" shape. The pre-martensite shape may be the shape imparted to the element when the element was hot-formed (e.g. by extrusion, casting, etc.). Alternately, the pre-martensite shape may be a shape mechanically imparted to the element (e.g. by bending, cold rolling, etc.) subsequent to formation if, after the mechanical working, the element was subjected to extreme heating (so as to transform the alloy to austenite) and rapid cooling (to produce martensite).

A more complete description of shape-memory alloys and the shape-memory effect (SME) is provided by Hodgson et al. in *Metals Handbook*®, Volume 2, 10th Edition, at pages 897 to 902, and by L. McDonald Schetky in "Shape-Memory Alloys", *Scientific American,* Vol. 241 No. 5, pages 74–82 (1979), both of which are incorporated by reference herein.

According to the preferred embodiment of the invention, the control band 64 is formed from a rectangular plate of a suitable nickel-titanium alloy which is specifically sized to ensure that, when the sprinkler 10 is in the non-actuated state and the control band 64 is under a residual static tensile load (e.g. up to about twenty pounds of force with the supplied mechanical advantage), which results from maximum residual and hydrostatic loads in the control lever 62, the deformation or deflection of the control band 64 from its unloaded shape shown in FIG. 3 does not result in a premature actuation of the sprinkler 10. The nickel-titanium alloy is selected so as to have a phase transition temperature range of between approximately 155° F. to 165° F. A suitable nickel-titanium or other marmem alloy may be ordered from a commercial supplier such as Memory Technologies in Brookfield, Conn.

Figure 4:
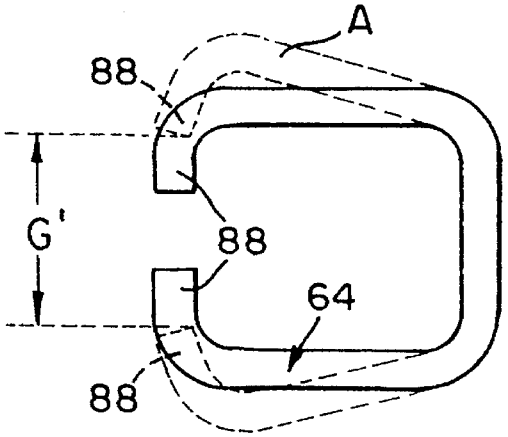
FIG. 4 is a top plan view of the shape-memory alloy actuator employed in the sprinkler of FIG. 1.
Figure 5:
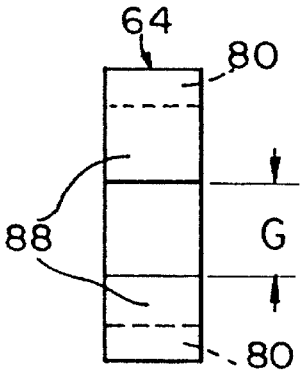
FIG. 5 is a side elevation view of the shape-memory alloy actuator from the left side of FIG. 4.

In manufacturing the control band 64, the nickel-titanium plate is preferably cold-worked (e.g. by bending or rolling)

to produce a band having the configuration or shape indicated in phantom at A in FIG. 4. In this configuration, the predetermined lateral gap G between the opposed ends 88 of the band 64 is selected to be slightly greater than a lateral width of the retainer member 60. Next, the band is heated to and held at a high temperature significantly above its phase transition temperature range so that a transition to austenite occurs. The austenire band is then rapidly cooled (e.g. quenched to room temperature) to produce the martensite phase; the configuration of the quenched band (indicated in phantom at A in FIG. 4) now represents the "pre-martensite" shape of the band. Subsequently, the martensite band is cold-worked (e.g. by bending) so as to decrease the spacing between the opposed ends 88 of the band 64 to approximately ⅓ of the predetermined lateral gap G (as indicated by the gap G' in FIG. 3); this represents the shape of the control band 64 in the low-temperature condition.

FIG. 3 shows a cross-section of the retaining mechanism 18 according to the preferred embodiment with the sprinkler in its non-actuated state. In this state, the SMA control band 64 is in the low-temperature condition and at least partially surrounds the locating member 58 and the retainer member 60. The opposed ends 88 of the spaced-apart arms 80 confront the alignment tab 70 and engage the respective tapered surfaces 72 provided on the retainer member 60. In other words, the lateral gap G' defined between the opposed ends 88 of the spaced-apart arms 80 is less than the lateral width of the retainer member 60. A path of force transmission is thus established between the control lever 62 and the locating member 58 through the intermediaries of the SMA control band 64 and the retainer member 60. Consequently, the third portion 78 of the control lever 62 reacts against the locating member 58 (and thus ultimately against the sprinkler body 12) through the force transmission path established in the SMA control band 64.

Sprinkler 10 operates as follows. When a fire condition does not exist, the temperature of the air surrounding the sprinkler 10 is relatively low. Accordingly, the SMA control band 64 is in the low-temperature (martensite) condition (i.e. below its predetermined transitional temperature range). In this condition, the control lever 62 and the locating member 58 are supported relative to the sprinkler body. That is, the first portion 74 of the control lever 62 reacts, through the intermediary of the locating member 58 and the deflector plate assembly 14, against the sprinkler body, the second portion 76 of the control lever 62 urges the valve plug 16 into sealing engagement with the fluid passage outlet 26, the third portion 78 of the control lever 62 reacts against the locating member 58 through the intermediary of the SMA control band 64 as described with reference to FIG. 3 above, and the locating member 58 reacts against the sprinkler body 12 and is supported on the deflector plate assembly 14. Accordingly, the valve plug 16 is retained in sealing engagement with the fluid passage outlet 26, and the sprinkler 10 is not actuated.

However, when a fire condition exists, the temperature of the air surrounding the sprinkler 10 becomes relatively high. As the ambient temperature rises and passes into and through the predetermined transitional temperature range of the control band, preferably approximately between about 155° F. to 165° F., the SMA control band 64 transforms from the low-temperature (martensite) condition or phase to the high-temperature (austenire) condition or phase. Accordingly, the SMA control band 64 reverts to its pre-martensite shape (shown in phantom in FIG. 4), and the distance as measured in the reference plane 3—3 between the spaced-apart arms 80 of the SMA control band 64 (and in particular, between the opposed ends 88) increases. The opposed ends 88 of the SMA control band 64 thus slide (in a substantially drag-free manner) along the tapered surfaces 72. Once the sprinkler 10 (and consequently the SMA control band 64) has been exposed to air having a temperature of between 155° F. and 165° F. for a sufficient length of time to be fully heated, the predetermined lateral gap G which existed between the opposed ends 88 of the SMA control band 64 in its "pre-martensite" shape (shown in phantom in FIG. 4) is at least substantially reestablished. Since the predetermined lateral gap G is slightly greater than the lateral width of the retainer member 60, due to the residual state of stress in the control lever 62, the retainer member 60 and consequently the locating member 58 passes through the predetermined lateral gap G in the SMA control band 64°. The SMA control band 64 consequently releases and becomes disengaged or disassociated from a force transmitting relationship with the locating member 58. The phrase, "becomes . . . disassociated from a force transmitting relationship with", means that the SMA control band 64 becomes incapable of reacting, either directly or indirectly through another component of the sprinkler 10, against the locating member 58. In other words, force transmission through the control band 64 between the third portion 78 of the control lever 62 and the locating member 58 (and ultimately the sprinkler body 12) is interrupted. Consequently, the third portion 78 of the control lever 62 pivots away from the locating member 58 e.g. due to the residual state of stress under which the control lever 62 was previously held. As a result of this pivotal movement, the second portion 76 of the control lever 62 is no longer urged against the valve plug 16 and the compressive force which previously held the locating member 58 between the deflector assembly 14 and the first portion 74 of the control lever 62 is relieved. The locating member 58 becomes unstable and thus pivots and falls from its upright position shown in FIGS. 1 and 2 and the second portion 76 of the control lever 62 moves (or falls) away from the valve plug 16.

As shown in FIGS. 1 and 2, a bowed spring member S is preferably mounted on the frame portion 22 so as to extend horizontally behind the locating member 58; the spring member S functions e.g. to ensure that the locating member 58 is quickly ejected from between the valve plug 16 and the deflecting cone 36 once the third portion 78 of the control lever 62 has pivoted away from the locating member 58.

When the locating member 58 and control lever 62 fall, an existing pressure in the fluid passage P forces the valve plug 16 downwardly (i.e away from the sprinkler body 12) and out of sealing engagement with the fluid passage outlet 26. Water in the conduit network (not shown) to which the sprinkler 10 is connected is subsequently discharged from the fluid passage P and impacts against the deflecting cone 36 and the deflector plate 38 prior to being dispersed onto the fire.

Figure 6:
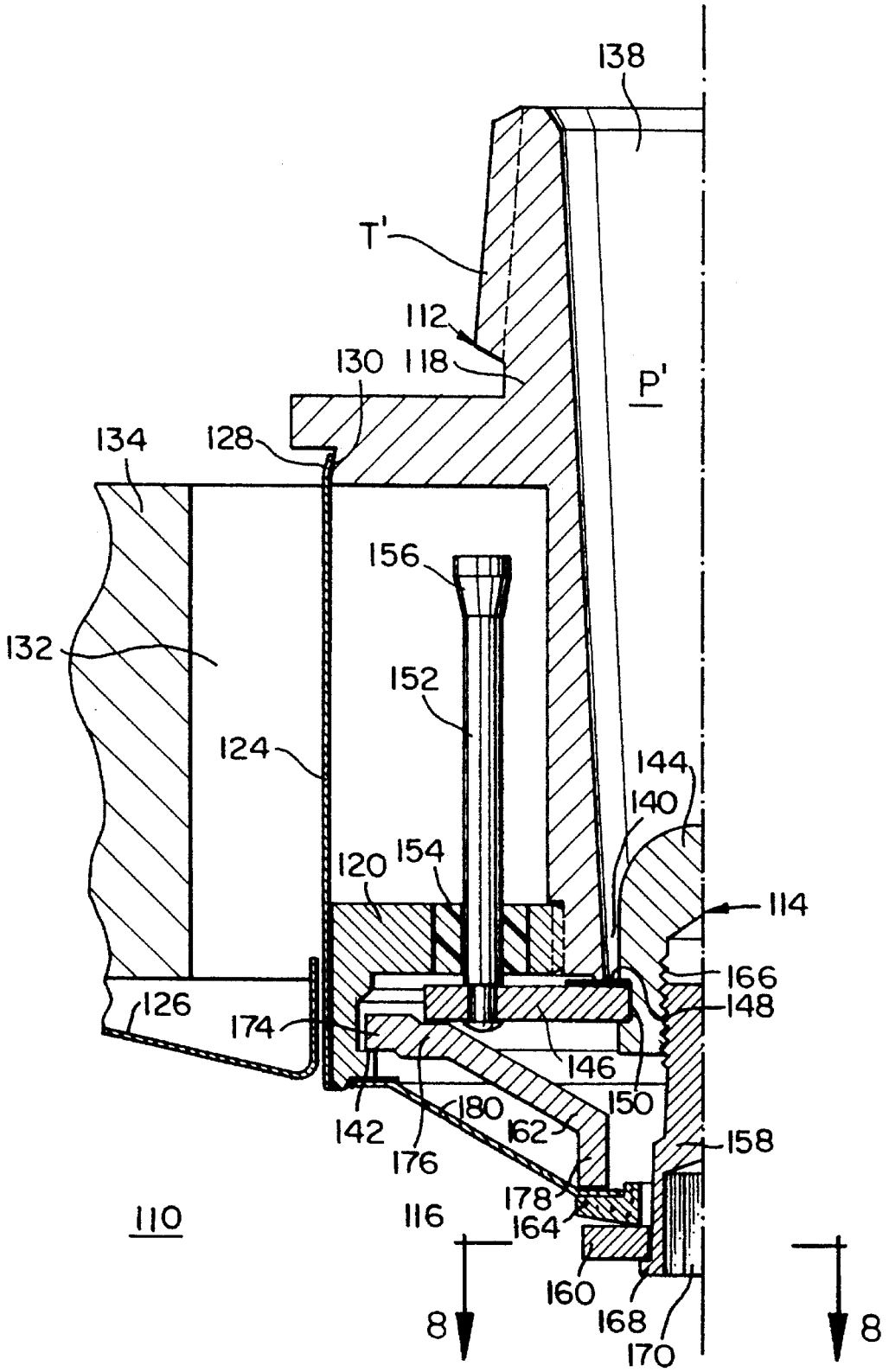
FIG. 6 is a quarter-sectional view of a sprinkler according to a second embodiment of the invention in a non-actuated state.
Figure 7:
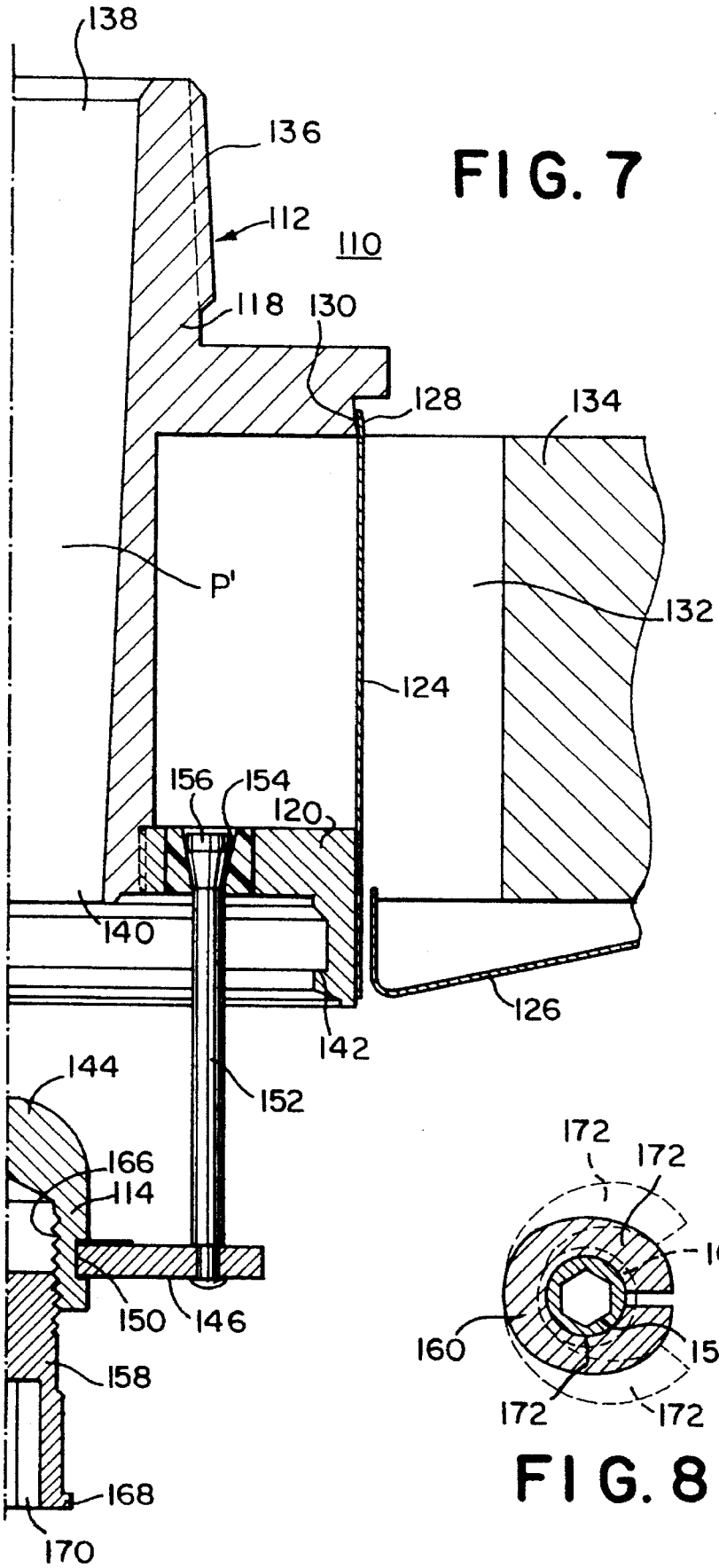
FIG. 7 is a quarter-sectional view of the sprinkler in FIG. 6 in an actuated state.
Figure 8:
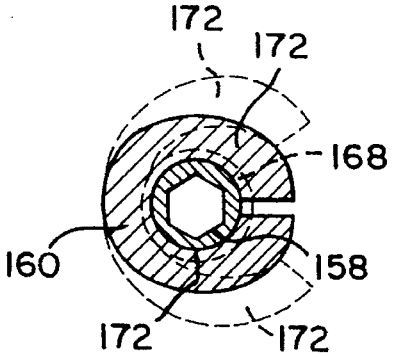
FIG. 8 is a cross-sectional view taken along lines 8—8 in FIG. 6.

FIGS. 6 to 8 reveal a second presently preferred embodiment of an automatic sprinkler according to the invention, indicated generally at 110. The sprinkler 110, which is based in part on the recessed sprinkler disclosed in U.S. Pat. No. 4,491,182, assigned to the assignee of the present invention and incorporated by reference herein, is shown in the non-actuated state in FIGS. 6 and 8 and in the actuated state in FIG. 7.

Referring to FIGS. 6 and 7, the sprinkler 110 includes a sprinkler body indicated generally at 112, a valve plug/deflector plate assembly indicated generally at 114, and a temperature-responsive retaining mechanism indicated generally at 116. The sprinkler body 112 includes a tubular body portion in 118 and an annular flange 120 securely fastened to the bottom of the tubular body portion in 118.

The tubular body 118 includes a threaded section 136, which is adapted to be connected to a conduit network (not shown) of a fire protection system, and defines a fluid passage P' having an inlet 138 and an outlet 140. The annular flange 120 defines a circumferential ledge 142 at a lower portion thereof.

The valve plug/deflector plate assembly 114 includes a plug element 144 formed integrally with a deflector plate 146. An annular sealing surface 148 is provided, for example, on a radially inward portion of the deflector plate 146. The plug element 144, together with the annular sealing surface 148, defines a valve plug for the fluid passage outlet 140. In the preferred embodiment, an annular step 150 is provided on a bottom portion of the plug element 144, and the deflector plate 146 is secured to the annular step 150 e.g. by swaging the bottom portion of the plug element 144. The plug element 144 and the deflector plate 146 could also be formed as a single, unitary element and in a variety of other, conventional forms. A plurality of circumferentially-spaced support pins 152 are fastened to or otherwise provided on the deflector plate 146. Each of the support pins 152 extends upwardly from the deflector plate 146, passes through a respective aperture 154 provided in the annular flange 120, and includes an enlarged head 156 having a diameter greater than the diameter of the respective aperture 154 in the form of a PTFE (or similar) bushing.

The retaining mechanism 116 includes a locating member 158, an SMA actuator in the form of a nickel-titanium control band 160, a plurality of (e.g. two) circumferentially-spaced control levers 162, and a ceramic insulator ring 164. The locating member 158 (which is made from brass, stainless steel, or other durable, conventional sprinkler material(s)) takes the form of a generally cylindrical insert which is threadingly and adjustably received within a downwardly opening bore 166 provided in the plug element 144. An annular radial flange 168 and a tool engagement section 170 are provided at a lower portion of the locating member 158. The radial flange 168 is preferably characterized by a burr-free finish. When the sprinkler 110 is in the non-actuated state, the radial flange 168 supports the control band 160. The control band 160, in turn, supports the insulator member 164. Insulator member 164 supports control levers 162 which in turn support the valve plug/deflector assembly 116.

As shown in FIG. 8, the control band 160 has a generally C-shaped cross-section as defined in a reference plane (indicated at 8—8 in FIG. 6), which extends laterally through the control band 160. The control band 160 includes a pair of integrally formed spaced-apart arms 172 which, in the low-temperature (martensite) condition, extend arcuately in opposite directions to define a substantially complete annulus having an inner diameter which is slightly greater than an outer diameter of the lower portion of the locating member 158 and slightly less than an outer diameter of the radial flange 168. As the control band 160 is heated to the high-temperature austenite (or other beta) condition, above its transitional temperature, the integrally formed, spaced-apart arms 172 of the control band 160 spread apart (as shown in phantom in FIG. 8) and the control band 160 expands radially so as to define an enlarged, split-annulus having an inner diameter which is at least as great as the outer diameter of the radial flange 168.

As shown in FIG. 6, each of the control levers 162 includes a first portion 174 which reacts against the circumferential ledge 142 of the sprinkler body 112, a second portion 176 which urges the valve plug/deflector plate assembly 114 into sealing engagement with the fluid passage outlet 140, and a third portion 178 which reacts against the radial flange 168 provided on the locating member 158, and thus ultimately against the sprinkler body 112, through the control band 160 and the insulator ring 164. Each of the control levers 162 is thus held in a residual state of stress when the sprinkler 10 is in the non-actuated state and retains the plug element 144 in sealing engagement with the fluid passage outlet 140.

Preferably, as shown in FIG. 6, a protective cone 180 is provided to cover the control levers 162 and the valve plug/deflector plate assembly 114 when the sprinkler 110 is in the non-actuated state. The protective cone 180 includes an inner periphery interposed between the insulator ring 164 and the third portion 172 of each of the control levers 162. It may be precoated with a low-friction compound, such as polytetrafluoroethylene (PTFE).

Sprinkler 110 operates as follows. When a fire condition does not exist, the temperature of the air surrounding the sprinkler 110 is relatively low and below the predetermined transitional temperature of the control band 160. Accordingly, the SMA control band 160 is in the low-temperature load supporting condition. Thus, the retaining mechanism 116, including the control levers 162 and the locating member 158, is supported relative to the sprinkler body, as shown in FIG. 6 on control band 160. In this condition, the first portion 174 of each control lever 162 reacts against the circumferential ledge 142 of sprinkler body 112, the second portion 176 of each control lever 162 urges the valve plug/deflector plate assembly 114 into sealing engagement with the fluid passage outlet 140, and third portion 178 of each control lever 162 reacts against the insulator member 164 through the control band 160 which reacts against the locating member 158. The locating member 158, in turn, reacts against the sprinkler body 112 through the valve plug/deflector plate assembly 114 and the control levers 162. Thus, the valve plug/deflector plate assembly 114 is held in sealing engagement with the fluid passage outlet 140 and the sprinkler 110 is maintained in the non-actuated state.

However, when a fire condition exists, the temperature of the air surrounding the sprinkler 110 becomes relatively high. As the temperature rises to approximately the preferred 155° F. to 165° F. transitional temperature of the SMA, the control band 160 commences a transition to the high-temperature condition (i.e. changes phase) and assumes the enlarged, split annulus shape described above as shown in phantom in FIG. 8. When the sprinkler 110 (and thus control band 160) has been exposed to heated air having a temperature of between 155° F. and 165° F. for a time sufficient to bring about this phase change, the inner diameter of the control band 160 enlarges sufficiently to allow the control band 160 to pass over the radial flange 168 (e.g. under the influence of gravity and/or reaction forces produced by the residual states of stresses in the control levers 162) and fall or be ejected from beneath the valve plug/deflector plate assembly 114. After the control band 160 has thus become disengaged from the radial flange 168 and disassociated from a force transmitting relationship with the control levers 162, the insulator ring 164 and the protective cone 180 also pass over the radial flange 168 and fall or are ejected from beneath the valve plug/deflector plate assembly 114. Each of the control levers 162 then pivots about the circumferential ledge 142 in such a manner that the third portion 178 of the control lever 162 moves downwardly and away relative to the locating member 158 and the second portion 176 of the control lever 162 moves away from the valve plug/deflector plate assembly 114. The control levers 162 then fall or are ejected from beneath the valve plug/deflector plate assembly 114. Thereafter, an existing pressure in the fluid passage P' forces the valve plug/deflector plate assembly 114 out of sealing engagement with the fluid passage outlet 140 and away from the sprinkler body 112. The valve plug/deflector plate assembly 114 moves downwardly until the enlarged heads 156 of the support pins 152 engage the annular PTFE (or similar) bushings 154 (as shown in FIG. 7), at which time the valve plug/deflector plate assembly 114 is again stably supported relative to the sprinkler body 112. Water in the conduit network (not shown) to which sprinkler 110 is connected is discharged from the fluid passage P' and impacts against the valve plug 144 and the deflector plate 146 prior to being dispersed onto the fire.

It will thus be apparent to those skilled in the art that the design and operation of the above-described temperature-responsive retaining mechanisms 18, 116, and in particular the shapes and material characteristics of the SMA actuators, permit the preferred embodiments of the invention to readily satisfy the UL Standard UL-199 for "Quick Response" commercial sprinklers. To satisfy this requirement, each temperature-responsive retaining mechanism must release within a predetermined time under predetermined heating conditions. More particularly, the mechanism 18, 116 must release an associated valve plug within about 14 seconds when the mechanism 18, 116 and particularly its SMA actuator (control band 64, 160, respectively) is exposed to a stream of hot air having a temperature of about 275° F. (275° ± 2° F.) and moving at a rate of about 8.33 feet per second (8.33 ± 0.05 feet per second) in the configuration and under the conditions required by the U.L. Standard 199. This achievement represents a significant advancement over the prior art.

From the foregoing descriptions, it can be seen that the preferred embodiments of the invention comprise automatic sprinklers having SMA actuators in the form of control bands. It will be appreciated, however, that changes and modifications may be made to the above described embodiments without departing from the inventive concepts thereof. For example, in the embodiment of FIGS. 1 to 5, the SMA control band 64 could be secured to the retainer member 60 instead of the control lever 62 or, alternately, to the locating member 58 itself if the retainer member 60 is eliminated, and the opposed ends 88 of the SMA control band 64 could be arranged to normally engage the control lever 62. The temperature-responsive retaining mechanism 18 could be employed in other frame-type sprinklers, such as are described in commonly assigned copending U.S. application Ser. No. 07/875,928, filed on Apr. 29, 1992 and incorporated by reference herein. A suitable shape-memory alloy other than nickel-titanium could be employed in the SMA control band. Instead of sustaining a tensile load, the SMA actuator could be modified to act under compression, and thus could be employed in sprinkler designs which currently employ frangible bulbs to hold control or actuating levers apart, such as disclosed in U.S. Pat. Nos. 4,976,320 and 5,083,616, both of which are incorporated by reference herein. It will be further appreciated that while reference has been made herein to a "predetermined temperature", being the phase transition temperature from martensite to austenite phase, that such a temperature is a theoretical minimum temperature required for an alloy in question and that the alloy may exhibit phase transition at different rates over a range of temperatures above the minimum temperature. Lastly, while it is presently preferred to employ the SMA actuator in sprinkler designs having levers for reducing the load experienced by the temperature-responsive element, it is conceivable that the SMA actuator could be employed directly to hold the valve plug in sealing engagement with the fluid passage outlet. Therefore, it is understood that the present invention is not limited to the particular embodiments disclosed, but is intended to include all modifications and changes which are within the scope and spirit of the invention as defined by the appended claims.

I claim:

1. A sprinkler, comprising:

a sprinkler body including a fluid passage having an inlet and an outlet;

a valve plug; and a temperature-responsive retaining mechanism supported by the sprinkler body and releasably retaining the valve plug in sealing engagement with the fluid passage outlet, the retaining mechanism including a temperature-responsive control band, a control lever, and a locating member, the control band having a generally C-shaped cross-section in a reference plane extending laterally through the control band and defining a pair of spaced-apart arms which extend laterally within the reference plane;

wherein when the control band is in a low-temperature condition, the control lever and the locating member are supported by the control band such that a first portion of the control lever reacts, at least indirectly, against the sprinkler body, a second portion of the control lever urges the valve plug into sealing engagement with the fluid passage outlet, a third portion of the control lever reacts against the locating member through the control band, and the locating member reacts, at least indirectly, against the sprinkler body to retain the valve plug in sealing engagement with the fluid passage outlet; and when the control band undergoes a transition from the low-temperature condition to a high-temperature condition, a distance between the spaced-apart arms of the control band increases as measured in the reference plane sufficiently for the control band to release at least one of the supported control lever and locating member with a relative movement between the third portion of the control lever and the locating member and a movement of the second portion of the control lever moves away from the valve plug, thereby permitting release of the valve plug from sealing engagement with the fluid passage outlet.

2. The sprinkler as recited in claim 1, wherein the control band comprises a shape-memory alloy, and wherein:

when the control band is in the low-temperature condition, a martensite phase of the shape-memory alloy exists; and when the control band undergoes the transition from the low-temperature condition to the high-temperature condition, the shape-memory alloy undergoes a transformation from the martensite phase to another phase.

3. The sprinkler as recited in claim 1, wherein the spaced-apart arms extend laterally from a base portion of the control band, the spaced-apart arms and the base portion of the control band remaining in a common plane when the control band undergoes the transition from the low-temperature condition to the high-temperature condition.

4. The sprinkler as recited in claim 3, wherein the base portion of the control band is rigidly secured to the control lever.

5. The sprinkler as recited in claim 4, wherein the locating member comprises a stem supported on a deflector plate assembly coupled with the sprinkler body.

6. The sprinkler as recited in claim 5, wherein, when the control band is in the low-temperature condition, the control band at least partially surrounds and reacts against the stem, and the first portion of the control lever reacts against the sprinkler body through the stem and the deflector plate assembly.

7. The sprinkler as recited in claim 6, wherein when the control band undergoes the transition from the low-temperature condition to the high-temperature condition, a predetermined lateral gap is established between opposed ends of the spaced-apart arms, and the stem passes through the predetermined lateral gap.

8. The sprinkler as recited in 7, wherein a retainer member is secured to the stem, the retainer member passing through the predetermined lateral gap when the control band undergoes the transition from the low-temperature condition to the high-temperature condition.

9. The sprinkler as recited in claim 8, wherein the retainer member is provided with an alignment tab which is disposed between the opposed ends of the spaced-apart arms when the control band is in the low-temperature condition.

10. The sprinkler as recited in claim 9, wherein the retainer member is provided with a pair of tapered surfaces which engage the opposed ends of the spaced-apart arms when the control band is in the low-temperature condition.

11. The sprinkler as recited in claim 4, wherein each of the spaced-apart arms is characterized by comprising a substantially uniform cross-section.

12. The sprinkler as recited in claim 1, the locating member is secured to the valve plug.

13. The sprinkler as recited in claim 12, wherein the sprinkler body comprises a reaction flange, and the first portion of the control lever reacts against the reaction flange when the control band is in the low-temperature condition.

14. The sprinkler as recited in claim 13, wherein the locating member comprises a radial flange, and wherein the third portion off the control lever reacts against the radial flange through the control band when the control band is in the low-temperature condition.

15. The sprinkler as recited in claim 14, wherein an insulator ring is interposed between the third portion of the control lever and the control band when the control band is in the low-temperature condition.

16. The sprinkler as recited in claim 15, wherein a deflector plate is provided integrally with the valve plug, and wherein the second portion of the control lever bears against the deflector plate so as tourge the valve plug into sealing engagement with the fluid passage outlet when the control band is in the low-temperature condition.

17. The sprinkler as recited in claim 14, wherein the control band expands radially and passes over the radial flange of the control member when the control band undergoes the transition from the low-temperature condition to the high-temperature condition.

18. A sprinkler, comprising:

a sprinkler body including a fluid passage having an inlet and an outlet;

a valve plug; and a temperature-responsive retaining mechanism supported by the sprinkler body releasably retaining the valve plug in sealing engagement with the fluid passage outlet, the retaining mechanism including a temperature-responsive control band and a control lever, the control band having a generally C-shaped cross-section in a reference plane extending laterally through the control band and defining a pair of spaced-apart arms which extend laterally within the reference plane;

wherein when the control band is in a low-temperature condition, the control lever is supported by the control band relative to the sprinkler body such that a first portion of the control lever reacts, at least indirectly, against the sprinkler body, a second portion of the control lever urges the valve plug into sealing engagement with the fluid passage outlet, and a third portion of the control lever reacts against the sprinkler body through at least the control band, to retain the valve plug in sealing engagement with the fluid passage outlet; and when the control band undergoes a transition from the low-temperature condition to a high-temperature condition, a distance between the laterally extending arms of the control band increases as measured in the reference plane sufficiently to permit a relative movement between the third portion of the control lever and the sprinkler body and a movement of the second portion of the control lever away from the valve plug, thereby permitting release of the valve plug from sealing engagement with the fluid passage outlet.

19. The sprinkler as recited in claim 18, wherein the control band is rigidly secured to the control lever by a spot weld.

20. The sprinkler as recited in claim 19, wherein the control band is rigidly secured to the control lever by a rivet.

21. A sprinkler, comprising:

a sprinkler body including a fluid passage having an inlet and an outlet;

a valve plug; and a temperature-responsive retaining mechanism supported by the sprinkler body releasably retaining the valve plug in sealing engagement with the fluid passage outlet, the retaining mechanism including a temperature-responsive control band, a control lever, and a locating member, the control band being rigidly secured to a first one of the control lever and the locating member;

wherein when the control band is in a low-temperature condition, the control lever and the locating member are stably supported relative to the sprinkler body by the control band such that a first portion of the control lever reacts, at least indirectly, against the sprinkler body, a second portion of the control lever urges the valve plug into sealing engagement with the fluid passage outlet, a third portion of the control lever reacts against the locating member through the control band, and the locating member reacts, at least indirectly, against the sprinkler body to retain the valve plug in sealing engagement with the fluid passage outlet; and when the control band undergoes a transition from the low-temperature condition to a high-temperature condition, the control band changes in shape sufficiently to release a second one of the control lever and the locating member, with a relative movement between the third portion of the control lever and the locating member and a movement of the second portion of the control lever away from the valve plug, thereby permitting release of the valve plug from sealing engagement with the fluid passage outlet.

22. The sprinkler as recited in claim 19, wherein the control band is rigidly secured to the control lever by a spot weld.

23. The sprinkler as recited in claim 19, wherein the control band is rigidly secured to the control lever by a rivet.

24. A sprinkler comprising:

a sprinkler body including a fluid passage having an inlet and an outlet;

a valve plug; and a temperature-responsive retaining mechanism including a temperature-responsive shape-memory alloy actuator changing shape with transition between different solid phases for releasing the valve plug from sealing engagement with the fluid passage outlet within 14 seconds when the shape-memory alloy actuator is exposed to a stream of hot air having a temperature of about 275° F. moving at a rate of about 8.33 feet per second.

25. A method of operating a sprinkler having a fluid passage inlet adapted to be connected to a source of fluid under pressure and a fluid passage outlet with a valve plug, the method comprising the steps of:

providing a temperature-responsive retaining mechanism releasably retaining the valve plug in sealing engagement with the fluid passage outlet, the temperature-responsive retaining mechanism including a shape-memory alloy actuator changing shape with transition between different solid phases;

automatically releasing the valve plug from sealing engagement with the fluid passage outlet within 14 seconds when the shape-memory alloy actuator is subjected to a stream of hot air having a temperature of about 275° F. and moving at a rate of about 8.33 feet per second.

26. The sprinkler of claim 24 wherein the shape-memory alloy of the actuator is selected to phase transition at a transition temperature of between about 155° F. to 165° F.

27. The sprinkler of claim 26 wherein the shape-memory alloy has a martensite crystalline phase below the transition temperature.

28. The sprinkler of claim 27 wherein the shape-memory alloy comprises nickel and titanium.

29. The method of claim 25 wherein the providing step comprises selecting the shape-memory alloys of the actuator to phase transition at a transition temperature of between about 155° F. to 165° F.

30. The method of claim 28 wherein the selecting step further comprises selecting the shape-memory alloy of the actuator to have a phase transition temperature of between about 155° F. to 165° F.

31. The sprinkler of claim 30 wherein the shape-memory alloy comprises nickel and titanium.

* * * * *